US009217310B2

(12) United States Patent
Shute et al.

(10) Patent No.: US 9,217,310 B2
(45) Date of Patent: Dec. 22, 2015

(54) INNER STRING CEMENTING TOOL

(75) Inventors: Daniel Mark Shute, Beaumont (CA); Maurice William Slack, Edmonton (CA)

(73) Assignee: NOETIC TECHNOLOGIES INC., Edmonton (CA)

( * ) Notice: Subject to any disclaimer, the term of this patent is extended or adjusted under 35 U.S.C. 154(b) by 225 days.

(21) Appl. No.: 14/114,911

(22) PCT Filed: Jun. 5, 2012

(86) PCT No.: PCT/CA2012/000548

§ 371 (c)(1), (2), (4) Date: Oct. 31, 2013

(87) PCT Pub. No.: WO2012/167358

PCT Pub. Date: Dec. 13, 2012

(65) Prior Publication Data

US 2014/0076538 A1 Mar. 20, 2014

Related U.S. Application Data

(60) Provisional application No. 61/493,481, filed on Jun. 5, 2011.

(51) Int. Cl.

| | |
|---|---|
| ***E21B 17/05*** | (2006.01) |
| ***E21B 33/13*** | (2006.01) |
| ***E21B 33/05*** | (2006.01) |
| ***E21B 33/126*** | (2006.01) |

(52) U.S. Cl.
CPC ..... *E21B 33/13* (2013.01); *E21B 17/05* (2013.01); *E21B 33/05* (2013.01); *E21B 33/126* (2013.01)

(58) Field of Classification Search
CPC ..... E21B 17/02; E21B 33/13; E21B 17/05
See application file for complete search history.

(56) References Cited

U.S. PATENT DOCUMENTS 6,595,288 B2 * 7/2003 Mosing ..... E21B 21/01 166/177.4

* cited by examiner

*Primary Examiner* — Catherine Loikith
(74) *Attorney, Agent, or Firm* — Donald V. Tomkins

(57) ABSTRACT

A cementing adaptor includes a cylindrical carrier carrying a casing seal, a middle interval and a lower end separated by an annular rib, and a cylindrical swivel element disposed around and coaxially rotatable relative to the middle interval. A cylindrical connector has an upper end rotatably disposed around the carrier's lower end and non-rotatably connected to the swivel element, plus a lower end connectable to an inner tubular string. With the carrier's upper end connected to a casing running tool (CRT), this assembly can be disposed within a casing string with the casing seal engaging the casing and preventing fluid flow into the casing annulus below the seal when cement is pumped down the inner string, such that the cement is urged into the wellbore annulus. The swivel connection limits torque transfer that might otherwise overload the CRT or its connection to the cementing adaptor.

20 Claims, 4 Drawing Sheets

INNER STRING CEMENTING TOOL

FIELD OF THE DISCLOSURE

The present disclosure relates in general to apparatus and methods for introducing fluids into a casing string or other tubular element during well construction operations, and for removing fluids from the casing string. In particular, the disclosure relates to apparatus and methods for introducing a fluid such as drilling mud or cement slurry into a casing string at a selected depth by means of a tubular inner string.

BACKGROUND

Typical construction of an oil or gas well includes the operations of assembling a casing string, inserting the casing string into a wellbore, and cementing the casing in place in the wellbore. Casing assembly involves connecting multiple individual lengths of pipe (or "joints") to form an elongate casing string. Threaded connections are usually used to join the individual lengths of pipe, requiring the application of torque to "make up" the connections, or to "break out" the connections should the string need to be disassembled. After a wellbore has been drilled to a desired depth into a subsurface formation, by means of a rotating drill bit mounted to the end of a drill string, the drill string is withdrawn and the casing string is then inserted essentially coaxially within the wellbore.

In the alternative method known as casing drilling (or "drilling with casing"), the wellbore is drilled with a drill bit mounted to the bottom of the casing string, eliminating the need for a separate drill string. After the well is drilled, the casing remains in the wellbore. As used in this patent document, the term "drill string" is to be understood, in the context of the drilling phase, as referring to the casing string for purposes of well construction operations using casing drilling methods.

During the drilling phase of well construction, a selected drilling fluid (commonly called "drilling mud") is pumped under pressure downward from the surface through the drill string, out through ports in the drill bit into the wellbore, and then upward back to the surface through the annular space that forms between the drill string and the wellbore (due to the fact that the drill bit diameter is larger than the drill string diameter). The drilling fluid, which may be water-based or oil-based, carries wellbore cuttings to the surface, and can serve other beneficial functions including drill bit cooling, and formation of a protective cake to stabilize and seal the wellbore wall.

Once the well has been drilled to a desired depth and the casing is in place within the wellbore, the casing is cemented into place by introducing a cement slurry (commonly referred to simply as "cement") into the wellbore annulus. This is typically done by introducing an appropriate volume of cement into the casing string (i.e., a volume corresponding to the volume of the wellbore annulus), and then introducing a second and lighter fluid (such as drilling mud or water) into the casing under pressure, such that the second fluid will displace the cement downward and force it out and around the bottom of the casing, and up into the wellbore annulus. In the typical case, this operation is continued until the cement has risen within the wellbore annulus up to the top of the casing. Once thus cemented, the casing acts to structurally line the wellbore and provide hydraulic isolation of formation fluids from each other and from wellbore fluids.

In some applications it is desirable to introduce cement into the casing through a tubular "inner string" inserted into the casing bore and arranged to extend from the proximal (i.e., upper) end of the casing string to a selected depth, typically near the distal (i.e., lower) end of the casing string or near what is referred to as the "casing shoe". The inner annulus between the inner string and casing is left fluid-filled and sealed near the proximal end of the casing so that cement pumped through the inner string is then introduced into the casing near the shoe. The fluid filling the inner annulus tends to prevent cement flow up the inside of the casing and instead the cement is urged to immediately enter the casing wellbore annulus during pumping. This is known in the art as an "inner string cement job" and typically requires an adaptor nubbin, sealingly connecting between the casing and the inner string. On top-drive-equipped rigs, the adaptor nubbin also connects to the top drive, facilitating the functions of rotation and reciprocation during cementing to further promote distribution of the cement in the casing to the wellbore annulus.

It is increasingly common in the drilling industry to use top-drive-equipped drilling rigs instead of traditional rotary table rigs, and to install casing (an operation commonly referred to as "casing running") and/or to drill with casing directly using the top drive. Casing running tools (CRTs), such as the "Gripping Tool" described in U.S. Pat. No. 7,909,120, connect to the top drive quill and support these well construction operations by engaging the upper end of the tubular string (i.e., drill string or casing string, as the case may be) so as to allow transfer of axial and torsional loads between the tubular string and the top drive, and to allow the flow of fluids (such as drilling mud and cement) into or out of the casing string through a central passage or bore in the tool. Such tools thus enable the top drive to be used for make-up and break-out of connections between joints of pipe, hoisting and rotation of tubular strings, casing fill-up, circulation of drilling mud, and cementing of casing.

BRIEF SUMMARY

The present disclosure teaches embodiments of cementing adaptor tools for sealingly connecting an inner string to the distal (lower) end of a CRT while also facilitating the functions of reciprocation and rotation, so that the CRT can be used to replace the function of the adaptor nubbin without the need to engage with the casing threads, thus providing a sealed flow path for cement into the inner string and thereby enabling the CRT to be used perform an "inner string cement job". This has the advantages of exploiting the existing capacity of the CRT to grip and seal with the casing, obviating the need for an adaptor nubbin customized to the casing thread (and thus removing the risk of damage to the casing thread), and eliminating the need to rig down the CRT after running the casing to replace it with the adaptor nubbin, thus saving time and reducing risk of damage.

Cementing adaptors in accordance with the disclosure are provided with a swivel connection for limiting torque that will typically arise during rotation of the inner string casing assembly as a result of frictional interaction between the inner string and the casing as they are rotated in wellbores having at least some deviation from vertical, thus inducing lateral loading between the casing's inner surface and tubular inner string's outer surface. It will be apparent to persons skilled in the art that right-hand rotation of the casing relative to the wellbore will tend to cause left-hand torque to build toward the proximal (upper) end of the inner string, which torque tends to back off the connections between the joints comprising the inner string (which are normally provided as right-hand-threaded connections).

The swivel connection further limits the torque that might otherwise overload the CRT or the connection between the cementing adaptor and the CRT. It will be apparent to persons skilled in the art that the swivel may take various forms and use various means to transfer loads from the inner string to the CRT while minimizing friction in the connection. Such alternative means may include (without being limited to) plain bushings, rolling element bearings, and pressurized fluid chambers.

To provide further protection for the CRT and the cementing adaptor against the risk of overload from bending loads that might arise from lateral gravity loads on the inner string in applications such as slant drilling (or other operations tending to displace the inner string away from substantially concentric alignment with the casing), suitable centralizers can be mounted to the inner string elements to act between the tubular inner string and the inside of the casing at selected locations along the length of the inner string to adequately support the inner string to a depth sufficient to prevent excess bending at the attachment point to the CRT or at any point in the inner string. It will be apparent to persons skilled in the art that the length and lateral stiffness of the inner string elements connecting the centralizers to the cementing adaptor can be selected to minimize bending loads at the attachment point.

Cementing adaptors in accordance with the present disclosure also provide means for sealing the annular space between the outer surface of the inner string and the inner surface of the casing, to prevent fluid in this annular space from being displaced out of the casing when cement is being pumped down the inner string, such that the cement is urged into the annular space between the outer surface of the casing and the wellbore.

Alternative embodiments of cementing adaptor tools in accordance with the present disclosure may also be adapted for use in conjunction with a plug-dropping manifold tool. A plug-dropping manifold tool, as is known to the art, has means to provide a swivel fluid entry to an inner string bore or tool bore, plus means for releasing one or more plugs (which may be ball plugs, wiper plugs or other similar devices), and include means for positively indicating the dropping of such plugs, while facilitating the functions of reciprocation and rotation by providing means for transferring axial and torsion loads from a top drive to the various tubulars used in oil well drilling and construction. In such embodiments, the cementing adaptor is attached to the distal (lower) end of a CRT mounted to the distal end of the plug-dropping manifold tool. The bores of the CRT and the inner string cementing tool are sized and aligned so that plugs released from the plug-dropping manifold tool will pass through the cementing adaptor and the inner string to provide functions including:

- separation of displacing fluids from displaced fluids;
- positive wiping of the inner surfaces of the casing to further enhance complete fluid displacement; and
- engagement with their intended targets located downhole from the inner string.

Downhole targets may include devices such as cement staging tools or subsea cementing wiper plug launchers where the casing wiper plug is carried at the distal end of the cementing string and launched when a dropped ball or dart is pumped down and into engagement with the device in a manner known in the art of well cementing. Cementing adaptor tools adapted for use with plug-dropping manifold tools provide the advantage of not having to rig out the CRT to launch plugs or to perform ball drops, and also facilitate side-entry fluid injection (mud or cement), which is desirable in cases where operators prefer not to have certain fluids or slurries (such as cement) run through the top drive.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1:
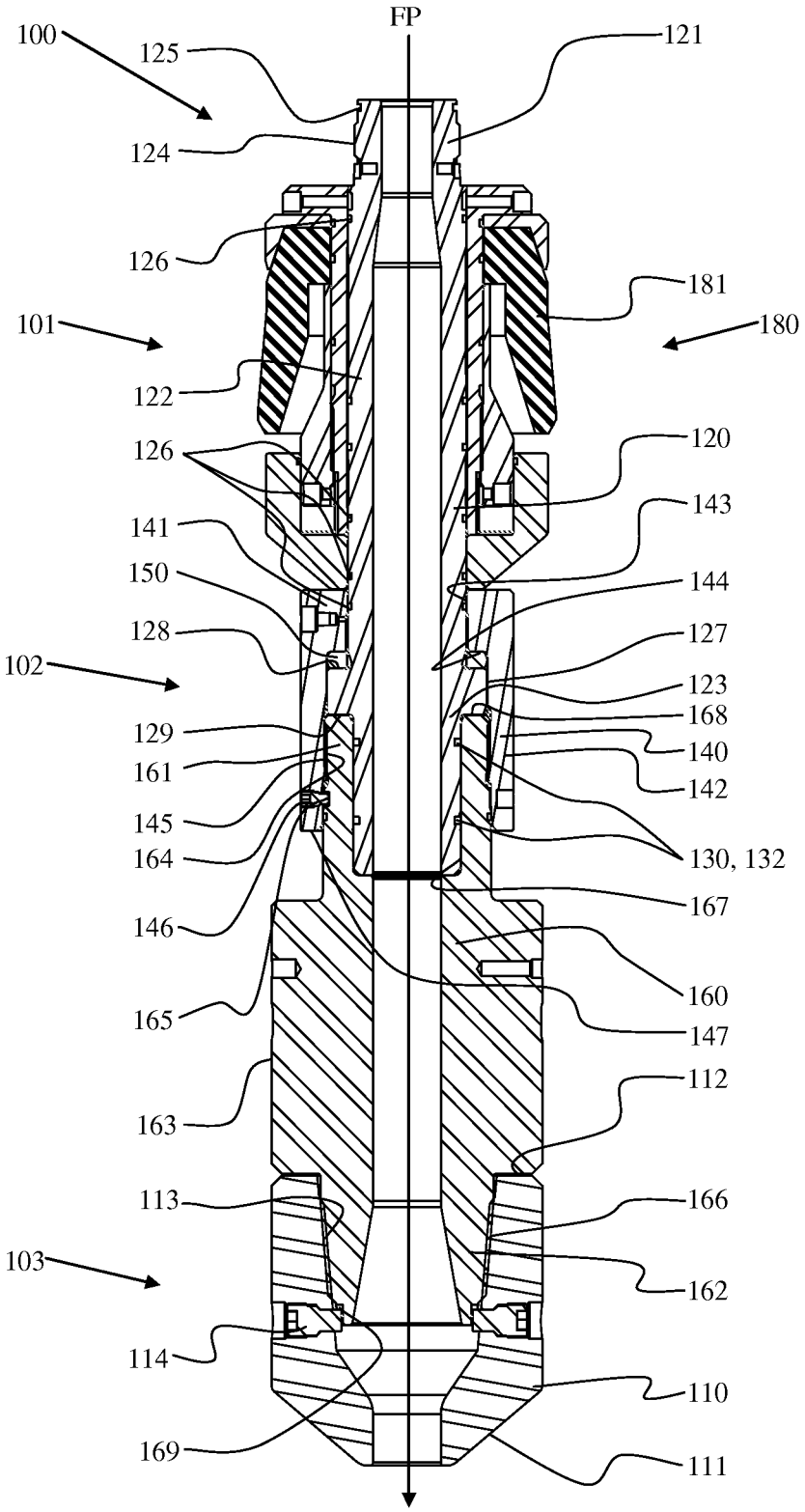
FIG. 1 is a cross-sectional view of an embodiment of a cementing adaptor tool in accordance with the present disclosure, shown fitted with a stab guide/thread protector to allow for normal casing running operations with the cementing adaptor attached.

FIGS. 1 through 4 illustrate embodiments of a cementing adaptor tool 100 in accordance with the present disclosure. Cementing adaptor 100 is of an elongate and generally cylindrical configuration, with a proximal (upper) end 101 that can be rigidly attached to a casing running tool (CRT) and a distal (lower) end 103 that can be rigidly attached to a tubular inner string. Cementing adaptor 100 is provided with an internal flow path FP and configured such that flow path FP will be continuous with and sealed to an internal flow path in the CRT after cementing adaptor 100 has been mounted to the CRT. This internal flow path FP generally runs the length of the tool and allows for flow of fluid from the CRT through the cementing adaptor from the proximal end to the distal end.

Disposed between the proximal and distal ends of cementing adaptor 100 is a swivel element which allows an inner string attached to the distal end of cementing adaptor 100 to rotate independently of the CRT, and to minimize torque build-up within the inner string and thus minimize torque transfer from the inner string to the CRT. The distal end of cementing adaptor 100 typically will incorporate the male end of a shouldering threaded connection designed to threadingly and sealingly engage the female (or box end) of an inner string (which typically will be made up from oilfield drill pipe). Cementing adaptor 100 further incorporates a casing seal assembly designed to seal the annular space between cementing adaptor 100 and a casing string.

Referring now to FIG. 1, cementing adaptor 100 with a proximal (upper) end 101, a middle interval 102, and a distal (lower) end 103 is shown in cross-sectional view with a stab guide 110 attached to distal end 103. Cementing adaptor 100 comprises an elongate and generally cylindrical carrier 120, a generally cylindrical swivel element 140, a generally cylindrical connector 160, and a generally cylindrical casing seal assembly 180. Carrier 120 extends between proximal end 101 and middle interval 102 of cementing adaptor 100 and has an upper end 121, a middle interval 122, and a lower end 123, with middle interval 122 and lower end 123 being separated or demarcated by an annular shoulder rib 127 extending radially outward from carrier 120. Swivel 140 is coaxially and rotatably disposed about middle interval 122 of carrier 120, above shoulder rib 127. A load thread 124 and a seal 125 are provided at upper end 121 of carrier 120. A plurality of seal grooves 126 are disposed along the outside surface of middle interval 122. Annular shoulder rib 127 defines an upward facing shoulder 128 and a downward facing shoulder 129. Lower end 123 is formed with a plurality of seal grooves 130.

In the illustrated embodiment, casing seal assembly 180 includes a packer cup 181 of a type common to many oilfield casing seal assemblies. Casing seal assembly 180 is coaxially carried by carrier 120, and sealingly engaged with one or more of seal grooves 126 on middle interval 122 of carrier 120. It is understood that the performance criteria for seal assembly 180 will vary depending on casing weights and pressure requirements and may be changed from job to job as required. It is also to be understood that various options exist for alternative casing seal arrangements, and that cementing adaptors in accordance with the present disclosure are not limited to the use of the illustrated casing seal arrangement or any other particular casing seal arrangement.

In the illustrated embodiment, swivel element 140 has an upper end 141, a lower end 142 with a lower end face 147, and an internal surface 143 defining a downward-facing annular shoulder 144 near upper end 141. Threads 145 are provided in a lower region of internal surface 143, and pins 146 are provided through openings in the cylindrical wall of swivel 140 below threads 145. Upper end 141 of swivel 140 sealingly engages a seal groove 126 on carrier 120 above shoulder rib 127. Downward-facing shoulder 144 is parallel and adjacent to upward facing shoulder 128 on shoulder rib 127, Shoulders 128 and 144 are separated by and mutually abutted by a friction-reducing bushing 150. Connector 160 has an upper end 161, a lower end 162, an inside cylindrical surface 167 and an annular upper face 168 at upper end 161, and an outer surface 163, with threads 164 on an upper region of outer surface 163 for mating engagement with threads 145 on swivel 140. A plurality of pockets 165 are formed into outer surface 163 for engagement with pins 146. Tapered threads 166 are provided on outer surface 163 at lower end 162.

It to be is understood that cementing adaptors in accordance with the present disclosure are not limited to embodiments incorporating the illustrated shouldering threaded connection. Depending on the application, this style of connection to the inner string may be modified either by providing a different connector or by providing a crossover to adapt the tool to a different size or style of connection.

Inside surface 167 at upper end 161 of connector 160 sealingly engages seals 132 disposed in seal grooves 130 on lower end 123 of carrier 120, while thread 164 engages thread 145 on swivel 140 and pins 146 engage pockets 165 to prevent thread disengagement and to react any torque generated through friction on shoulder 144. Upper face 168 of connector 160 abuts downward-facing shoulder 129 of carrier 120. Stab guide 110, with lower tapered face 111, upper shoulder 112, tapered internal thread 113, and locking pins 114, loosely threadingly engages tapered thread 166 on connector 160. Locking pins 114 engage pockets 169 on lower end 162 of connector 160 to prevent thread disengagement and to react any incidental torque.

Figure 2:
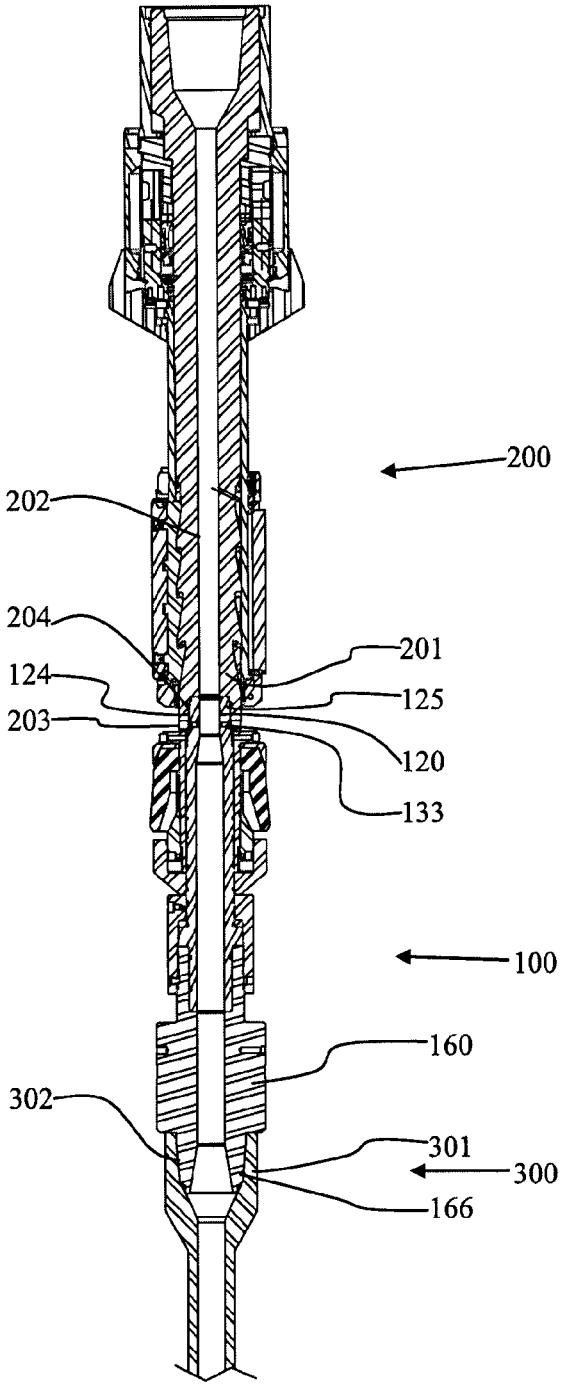
FIG. 2 is a cross-sectional view of the cementing adaptor tool in FIG. 1, shown as it would appear disposed between and attached to a casing running tool and an inner string.

With reference now to FIG. 2, cementing adaptor 100 is shown disposed between and rigidly attached to the lower end 201 of a casing running tool (CRT) 200 (such as, by way of example only, a "Gripping Tool" as described in U.S. Pat. No. 7,909,120) and the upper end 301 of an inner string 300. Carrier 120 of cementing adaptor 100 is rigidly attached to and in sealing engagement with the inside surface 202 on the lower end of CRT 200. In this embodiment, the attachment method is a threaded and pinned arrangement wherein axial load is carried by thread 124 on carrier 120 and the mating thread on CRT 200, and torque is reacted in shear through a plurality of cap screws 203 in holes 133 on carrier 120. A seal 125 engages a seal face 204 on CRT 200 to provide a continuous sealed bore through the CRT 200 and adaptor 100. Still referring to FIG. 2, tapered and shouldered thread 166 of connector 160 is shown engaged with a female tapered shouldering thread 302 on the upper end 301 of an inner string 300, providing rigid attachment and sealing engagement.

Figure 3:
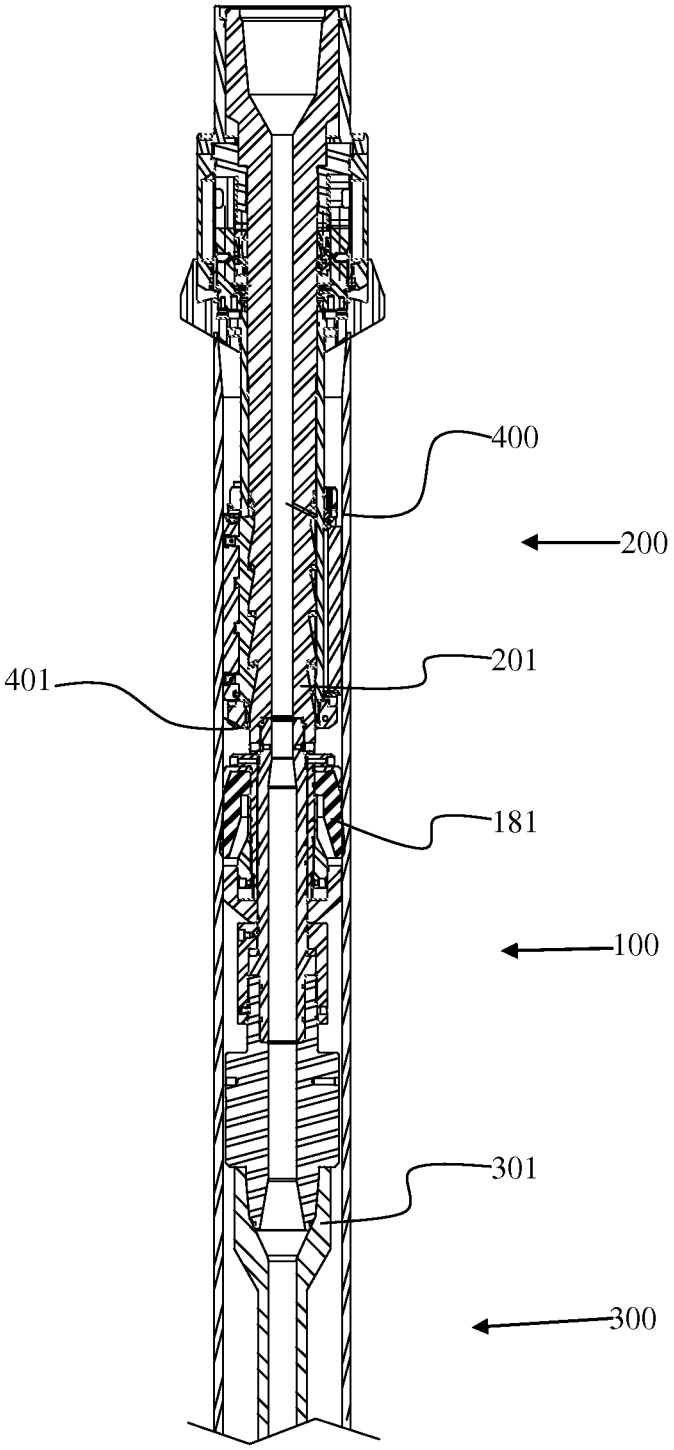
FIG. 3 is a cross-sectional view of the assembly in FIG. 2, disposed within a tubular casing string with the casing running tool grippingly engaging the casing string.

Referring now to FIG. 3, cementing adaptor 100 is shown disposed between and rigidly attached to lower end 201 of CRT 200 and upper end 301 of inner string 300. CRT 200 is shown engaged with and gripping a casing string 400. Packer cup 181 is shown engaged with the inner surface 401 of casing string 400, sealing off the annular space below packer cup 181 between cementing adaptor 100 and inner surface 401 of casing string 400 from the annular space above packer cup 181 between CRT 200 and inner surface 401 of casing string 400. As thus arranged, CRT 200 is able to hoist, rotate, and reciprocate the casing, with any incidental relative rotation as a result of the tumbling action of inner string 300 within casing 400 (such as in a deviated wellbore) being relieved through the action of swivel 140. This arrangement thus facilitates and enables the functions required for running an inner string cementing job, including rotation and reciprocation of the casing string, taking into consideration the hoisting and torque capacities of both the system as a whole and its individual components.

Figure 4:
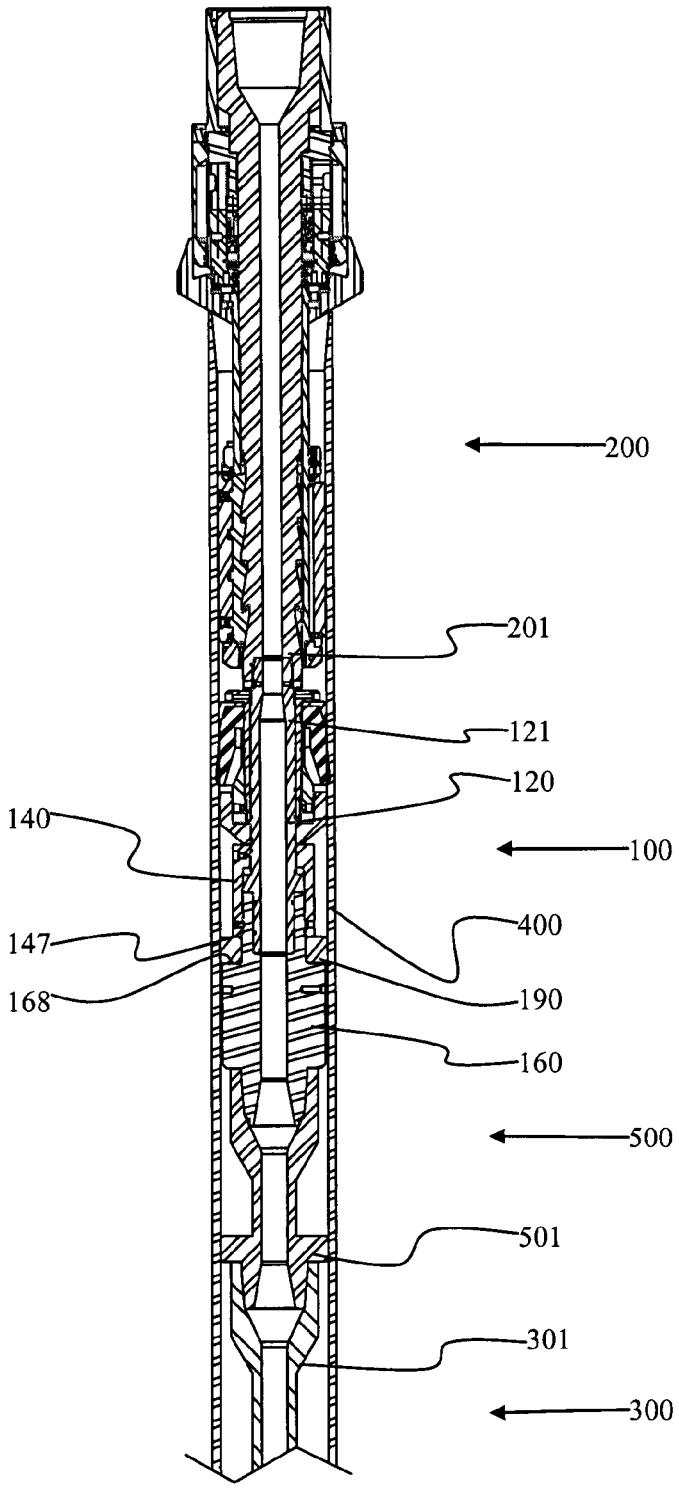
FIG. 4 is a cross-sectional view of an assembly generally as in FIG. 2, but with an inner string centralizing pup mounted between the inner string and the lower end of the cementing adaptor tool.

Referring now to FIG. 4, cementing adaptor 100 is shown disposed between and rigidly attached to lower end 201 of CRT 200 and upper end 301 of inner string 300, with CRT 200 engaging and gripping casing string 400, generally as seen in FIG. 3. In this arrangement, however, an inner string pup 500 with a centralizing flange 501 is disposed between and attached to connector 160 and inner string 300, and a side load bushing flange 190 is disposed between upward-facing shoulder 168 on connector 160 and lower end face 147 of swivel 140. Both the outer diameter of bushing flange 190 and centralizing flange 501 are selected to be close to the minimum allowable casing diameter (or "drift"). The arrangement of these centralizing flanges prevents side loads induced by slant-drilling operations (or other forces tending to displace the inner string eccentric from substantially coaxial alignment with the casing) from overloading carrier 120 in bending, which would typically occur in the region of minimum section near upper end 121 of carrier 120. It to be is understood that when significant side load is anticipated during an inner string cementing job, the axial spacing of these flanges can be selected in consideration of the compliance of both the cementing adaptor and the inner string, and in consideration of the clearance between the outer diameter of the flanges and the inner diameter of casing 400, to prevent excessive bending stresses in cementing adaptor 100 and CRT 200.

It will be readily appreciated by those skilled in the art that various modifications of cementing adaptor tools in accordance with the present disclosure may be devised without departing from the scope and teaching of the present disclosure, including modifications which may use equivalent structures or materials hereafter conceived or developed. It is to be especially understood that the disclosure is not intended to be limited to any described or illustrated embodiment, and that the substitution of a variant of a claimed element or feature, without any substantial resultant change in function or operation, will not constitute a departure from the scope of the disclosure. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element.

Any use of any form of the terms "connect", "engage", "attach", "mount", or any other term describing an interaction between elements is not meant to limit the interaction to direct interaction between the subject elements, and may also include indirect interaction between the elements such as through secondary or intermediary structure.

Relational terms such as "parallel", "concentric", and "coaxial" are not intended to denote or require absolute mathematical or geometrical precision. Accordingly, such terms are to be understood as denoting or requiring general or substantial precision only (e.g., "generally parallel" or "substantially parallel") unless the context clearly requires otherwise.

Wherever used in this document, the terms "typical" and "typically" are to be interpreted in the sense of representative or common usage or practice, and are not to be understood as implying invariability or essentiality.

The embodiments of the invention in which an exclusive property or privilege is claimed are defined as follows:

1. A cementing adaptor tool comprising:

(a) an elongate cylindrical carrier having: an upper end; a middle interval; and a lower end with a cylindrical outer surface; said middle interval and said lower end being separated by an annular rib defining an upward-facing shoulder and a downward-facing shoulder;

(b) a casing seal assembly associated with the upper end of the carrier;

(c) a swivel element rotatably disposed about the middle interval of the carrier, said swivel element having: an upper end; a lower end with a lower end face; and an internal surface defining a downward-facing annular shoulder near the upper end of the swivel element, said internal surface having a threaded portion near the lower end of the swivel element;

(d) bushing means disposed between the downward-facing annular shoulder on the swivel element and the upward-facing shoulder on the annular rib; and (e) a cylindrical connector having: an upper end defining an upward-facing annular shoulder and an outer surface threaded for engagement with the threaded portion of the swivel element; and a lower end engageable with an inner string; said upper end of the connector being coaxially, sealingly, and rotatably engageable with the lower end of the carrier, and coaxially and non-rotatably engageable with the swivel element;

wherein an internal flow path extends longitudinally through the carrier and the connector.

2. The cementing adaptor tool as in claim 1 wherein the casing seal assembly comprises a packer cup.

3. The cementing adaptor tool as in claim 1 wherein the upper end of the connector defines a cylindrical pocket for rotatably receiving the lower end of the carrier.

4. The cementing adaptor tool as in claim 1 wherein the upper end of the connector non-rotatably engages the swivel element by means of a threaded connection.

5. The cementing adaptor tool as in claim 4, further comprising a plurality of pins extending radially through the swivel element into the upper end of the connector to prevent relative rotation therebetween.

6. The cementing adaptor tool as in claim 1, further comprising an inner tubular string coaxially connected to the lower end of the connector.

7. The cementing adaptor tool as in claim 6, further comprising an inner string pup coaxially disposed between and connected to the connector and the inner tubular string, said inner string pup having a centralizing flange.

8. The cementing adaptor tool as in claim 6, further comprising centralizer means mounted to the inner tubular string.

9. The cementing adaptor tool as in claim 1, further comprising a side load bushing flange disposed between the upward-facing annular shoulder on the connector and the lower end face of the swivel element.

10. A tool assembly comprising:

(a) a cementing adaptor tool comprising:

a.1 an elongate cylindrical carrier having: an upper end; a middle interval; and a lower end with a cylindrical outer surface; said middle interval and said lower end being separated by an annular rib defining an upward-facing shoulder and a downward-facing shoulder;

a.2 a casing seal assembly associated with the upper end of the carrier;

a.3 a swivel element rotatably disposed about the middle interval of the carrier, said swivel element having: an upper end; a lower end with a lower end face; and an internal surface defining a downward-facing annular shoulder near the upper end of the swivel element, said internal surface having a threaded portion near the lower end of the swivel element;

a.4 bushing means disposed between the downward-facing annular shoulder on the swivel element and the upward-facing shoulder on the annular rib; and a.5 a cylindrical connector having: an upper end defining an upward-facing annular shoulder and an outer surface threaded for engagement with the threaded portion of the swivel element; and a lower end engageable with an inner string; said upper end of the connector being coaxially, sealingly, and rotatably engageable with cementing adaptor tool the lower end of the carrier, and coaxially and non-rotatably engageable with the swivel element;

wherein an internal flow path extends longitudinally through the carrier and the connector; and (b) a casing running tool (CRT) having:

b.1 an upper end and a lower end;

b.2 a fluid passage extending between the upper and lower ends of the CRT; and b.3 means for grippingly engaging a tubular string;

wherein said lower end of the CRT is rigidly and sealingly attached to the upper end of the carrier of the cementing adaptor tool, such that the fluid passage of the CRT is in fluid communication with the internal flow path of the cementing adaptor tool.

11. The tool assembly as in claim 10 wherein the casing seal assembly comprises a packer cup.

12. The tool assembly as in claim 10 wherein the upper end of the connector defines a cylindrical pocket for rotatably receiving the lower end of the carrier.

13. The tool assembly as in claim 10 wherein the upper end of the connector non-rotatably engages the swivel element by means of a threaded connection.

14. The tool assembly as in claim 13, further comprising a plurality of pins extending radially through the swivel element into the upper end of the connector to prevent relative rotation therebetween.

15. The tool assembly as in claim 10, further comprising an inner tubular string coaxially connected to the lower end of the connector.

16. The tool assembly as in claim 15, further comprising an inner string pup coaxially disposed between and connected to the connector and the inner tubular string, said inner string pup having a centralizing flange.

17. The tool assembly as in claim 15, further comprising centralizer means mounted to the inner tubular string.

18. The tool assembly as in claim 10, further comprising a side load bushing flange disposed between the upward-facing annular shoulder on the connector and the lower end face of the swivel element.

19. The tool assembly as in claim 10 wherein:

(a) the lower end of the CRT is attached to the upper end of the carrier of the cementing adaptor tool by means of a threaded connection for transferring axial load; and (b) a plurality of shear-resisting pin members are provided for transferring torque between the CRT and the carrier.

20. The tool assembly as in claim 19 wherein the plurality of shear-resisting pin members comprise one or more cap screws.

* * * * *